US006849005B2

(12) United States Patent
Rife

(10) Patent No.: US 6,849,005 B2
(45) Date of Patent: Feb. 1, 2005

(54) IRON TYPE GOLF CLUB

(76) Inventor: Guerin DuBose Rife, 503 N. Interlachen Ave. #8, Winter Park, FL (US) 32789

( * ) Notice: Subject to any disclaimer, the term of this patent is extended or adjusted under 35 U.S.C. 154(b) by 0 days.

(21) Appl. No.: 10/051,011

(22) Filed: Jan. 22, 2002

(65) Prior Publication Data

US 2003/0139225 A1 Jul. 24, 2003

(51) Int. Cl.[7] ..... A63B 53/04

(52) U.S. Cl. ..... 473/350; 473/290; 473/324; 473/350; 473/332

(58) Field of Search ..... 473/349, 332, 473/334, 335, 341, 344, 350

(56) References Cited

U.S. PATENT DOCUMENTS

| | | | | | |
|---|---|---|---|---|---|
| 3,079,157 | A | | 2/1963 | Turner | 273/167 |
| 4,420,156 | A | * | 12/1983 | Campau | 473/291 |
| 4,645,207 | A | * | 2/1987 | Teramoto et al. | 473/290 |
| 5,048,835 | A | * | 9/1991 | Gorman | 473/350 |
| 5,120,062 | A | * | 6/1992 | Scheie et al. | 473/314 |
| 5,224,705 | A | * | 7/1993 | Scheie et al. | 473/291 |
| 5,390,924 | A | * | 2/1995 | Antonious | 473/328 |
| 5,423,546 | A | * | 6/1995 | Manning et al. | 473/331 |
| D361,813 | S | | 8/1995 | Guibaud et al. | D21/220 |
| 5,562,551 | A | | 10/1996 | Rife | 473/291 |
| 5,586,947 | A | * | 12/1996 | Hutin | 473/324 |
| 5,643,112 | A | * | 7/1997 | Besnard et al. | 473/350 |
| 5,658,208 | A | * | 8/1997 | Shimasaki | 473/349 |
| 5,722,900 | A | | 3/1998 | Sung | 473/291 |
| 6,086,485 | A | * | 7/2000 | Hamada et al. | 473/329 |
| D437,625 | S | | 2/2001 | Turner | D21/749 |
| 6,186,903 | B1 | | 2/2001 | Beebe et al. | 473/248 |
| 6,210,290 | B1 | | 4/2001 | Erickson et al. | 473/345 |
| D443,008 | S | | 5/2001 | Kubica et al. | D21/747 |

* cited by examiner

*Primary Examiner*—Glenn Caldarola
*Assistant Examiner*—Tom P Duong
(74) *Attorney, Agent, or Firm*—Welsh & Flaxman LLC

(57) ABSTRACT

An iron type golf club head having a rear surface having upper and lower portions; the upper portion being defined by a blade type iron structure between a top ridge surface and the lower portion; and a lower peripheral weight on the lower portion of the rear surface forming a rear cavity between the bottom sole surface the said upper portion.

9 Claims, 8 Drawing Sheets

FIG. 9
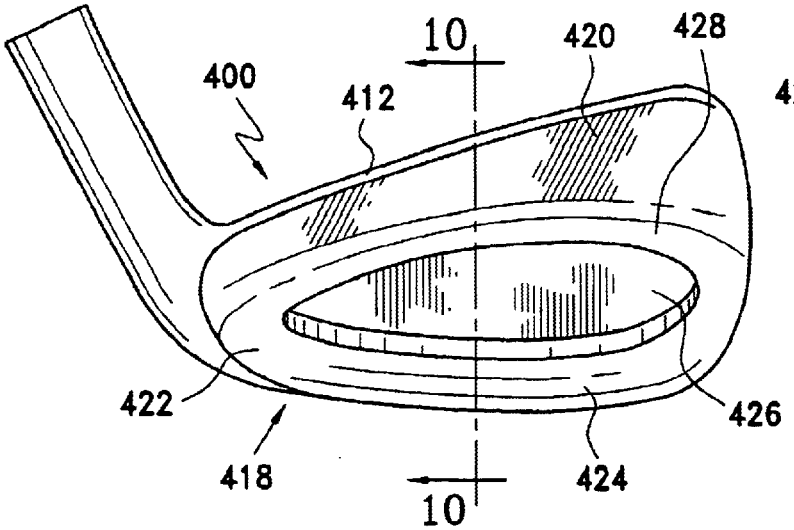
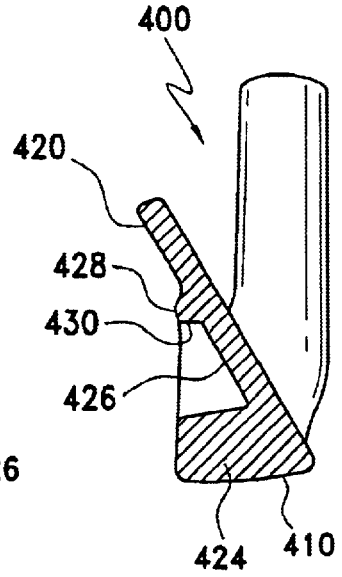
FIG. 10
FIG. 11
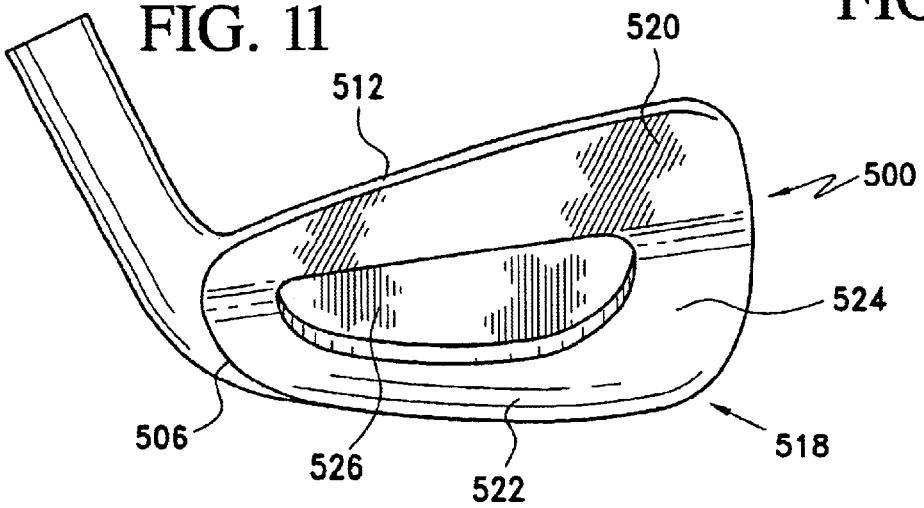
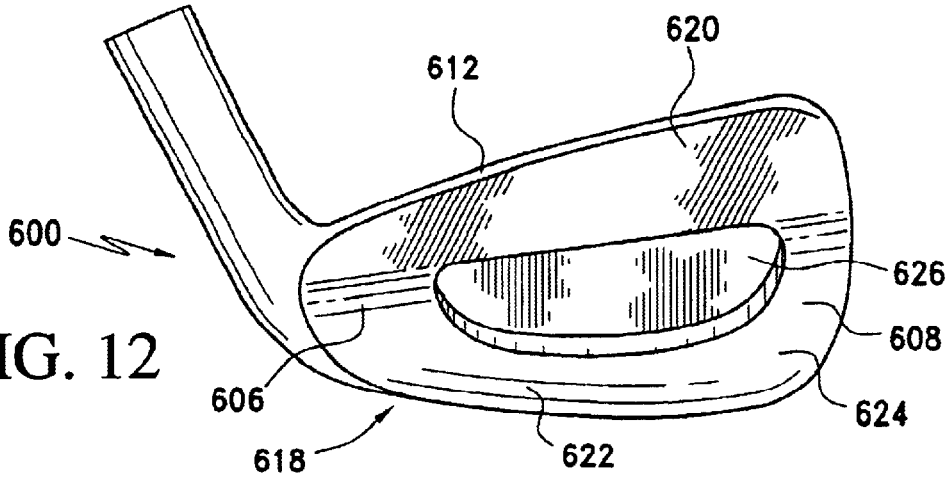
FIG. 12

IRON TYPE GOLF CLUB

BACKGROUND AND SUMMARY OF THE INVENTION

The present invention relates to golf clubs and, in particular, to iron type golf club heads having an improved weight distribution at the rear club face surface. Iron type golf club heads have been designed with a number of different weighting systems to improve the shot making characteristics of golf clubs. Conventional irons typically are blade types or cavity back, peripheral weight irons. It is understood that the term blade refers to any non-peripheral weighted, iron type club head having an area of generally uniform thickness in a heel to toe direction and having a progressively thicker structure in a top to bottom direction. The blade type iron construction may be formed with a muscle back type bulge which is an area of more concentrated thickness, preferably behind the percussion area on the club face. Other blade iron designs may have a generally flat surface, or be slightly curved, for example, convex or concave, on the rear surface, or variations of the same. The blade iron provides increased feel to a golfer because vibration is evenly transmitted through the uniform thickness of the club head, particularly when a golf ball is struck at or very near the center of percussion on the club face.

Blade types of iron configurations are preferred by professional golfers and other golfers with considerable skill levels because these irons provide better feel when a golf ball is struck squarely on the center of percussion. A well known drawback of these type golf clubs is a loss of feel and shot making performance when the golf ball is struck off the exact center of percussion.

Because most golfers have limited ability, cavity back, peripheral weighted iron designs have been developed. These cavity back, peripheral weighted irons provide a greater moment of inertia to resist twisting and turning of the club head when off-center hits occur during a golf swing. This is accomplished by concentrating the mass of the club head away from the center toward the outer periphery of the club head. This peripheral weight forms a rear cavity on the rear face leaving a thinner mass behind the area of percussion and locates the majority of the rear weight along the bottom, top, and heel and toe portions of the golf club. This peripheral weight configuration produces a more forgiving area of contact, or percussion, allowing less proficient golfers to hit better golf shots to the intended target. The disadvantage of this club head design is reduced feel from the lack of mass or weight concentration behind the center of percussion.

Thus blade irons produce more feel but are less forgiving, while perimeter weighted irons produce greater forgiveness, but have less feel. Various attempts have been made to create an iron club head design that provides the best features of both peripheral weight and blade designs. In my own U.S. Pat. No. 5,562,551, the rear of an iron golf club is formed with an upper peripheral weight and cavity in combination with a flat blade or muscle back surface configuration at the lower portion of the club head. Other examples of iron golf clubs with unique weight configurations are disclosed in U.S. Pat. Nos. 5,395,113, 5,046,733, 5,014,993, 5,011,151, 4,938,470, 4,932,658, 4,919,431, 4,919,430, 4,915,386, 4,907,806 and 4,826,172 to A. J. Antonious, U.S. Pat. No. 3,814,437 to Winquist, U.S. Pat. No. 5,290,032 to Fenton et al and U.S. Pat. No. 5,595,552 to Wright et al. In these patents, the club head designs combine peripheral weight with various supplemental weights on the rear surface of the club head to enhance weight distribution and shot making performance.

The iron type golf club heads of the present invention represent an improvement of the known prior art. The present invention combines the best properties of the blade iron, which concentrates mass behind the center of percussion and the cavity back iron, which places mass to the outer edges. The present invention places mass to the outer edge of the lower area only, concentrating perimeter weight to the lower portion of the club head where the golf ball is hit virtually all the time. Thus the club head design of the present invention provides structural features to maximize golf ball striking performance for both solid and off-center hits. Therefore, a solid hit provides increased feel, as compared to a conventional peripheral weighted cavity back iron, and, off-center hits provide increased forgiveness as compared to a conventional blade type iron golf club.

To accomplish the above, an iron type golf club head is provided with a hosel, a club head body including a heel, toe, bottom sole, top ridge, a ball striking face with a loft greater than 12 degrees, and a leading edge defined by the intersection of the ball striking face and the bottom sole. Preferred embodiments further include a unique rear surface configuration in the form of a weighting system having a peripheral weight and rear cavity formed thereby, which is located on a lower portion of the rear surface of the club head, below the top portion of the rear surface and spaced from the top ridge of the club head. In preferred embodiments, this rear surface weight configuration extends upwardly from the bottom sole on the lower half to as much as the lower two third portion of the rear surface toward the top ridge, the remaining upper portion having a blade type configuration. The overall height, width and depth of the rear peripheral weight may be varied to accommodate golfers of all skill levels and to provide a variety of different ball flight characteristics.

The rear surface weight configuration of the golf club head of the present invention allows all caliber of golfers to improve their shot making, by providing the forgiveness of a perimeter weighted, iron type, golf club, while producing the feel of a blade type golf club. Because golf balls are almost never hit on the club face at or toward the top ridge portion of the club head, the present invention provides a lowering of the peripheral weight found on most conventional golf clubs, to an area on the rear surface adjacent the place on the club face where most golf shots are hit. The peripheral weight on the rear surface of the club head is configured at or around a point on the rear surface that is opposite the center of percussion on the club face. Thus golf balls hit on the center of percussion have the benefit of increased mass configured closer to the center of percussion, whereas golf balls mis-hit toward the bottom of the club head and/or toward the toe or heel of the club head, have the benefit of increased moment of inertia because of the heel, toe and bottom peripheral weight configuration to reduce the effects of twisting the club head, keeping the golf ball in a straighter trajectory toward the intended target. The lowering of the cavity formed by the peripheral weight away from the upper portions of the rear surface of the club head toward the bottom, produces a club head which is more structurally sound therefore producing more solid feel, no matter where impact occurs on the club face.

A primary object of the present invention is the provision of an improved iron type golf club head with a weighting system providing the solid feel of a blade-type club head along with the forgiveness of a peripheral weighted club head.

Another object of the present invention is the provision of an improved iron type golf club head that locates a rear cavity formed by peripheral weight directly behind the area of percussion on the club face.

Another object of the present invention is the provision of an improved iron type golf club head that locates a predominance of weight on its rear surface opposite the area on the club face where most golf balls are struck.

Yet another object of the present invention is the provision of an iron type golf club head having a weighting system that provides a peripheral weight on the lower portion of the rear surface of the club head.

Another object of the present invention is the provision of an iron type golf club head having a peripheral weighting cavity located up to two thirds of the distance between the bottom sole and top ridge on the rear surface of the club head.

Still another object of the present invention is the provision of an iron type golf club head wherein the size and location of the rear peripheral weight may be adjusted to create selected shot making characteristics.

Still another object of the present invention is the provision of an iron type golf club head wherein the mass on the rear of a club head is relocated closer to the area where ball impact normally occurs.

Other objects and advantages of the present invention will become apparent from the following detailed description and drawings, which set forth embodiments of the invention.

DESCRIPTION OF DRAWINGS

FIG. 9 is a rear elevation view of a forth embodiment of a golf club head in accordance with the present invention.

FIG. 10 is a sectional view taken along lines 10—10 of FIG. 9.

FIG. 11 is a rear elevation view of a fifth embodiment of a golf club head in accordance with the present invention.

FIG. 12 is a rear elevation view of a sixth embodiment of a golf club head in accordance with the present invention.

DESCRIPTION OF THE PREFERRED EMBODIMENTS

Figure 1:
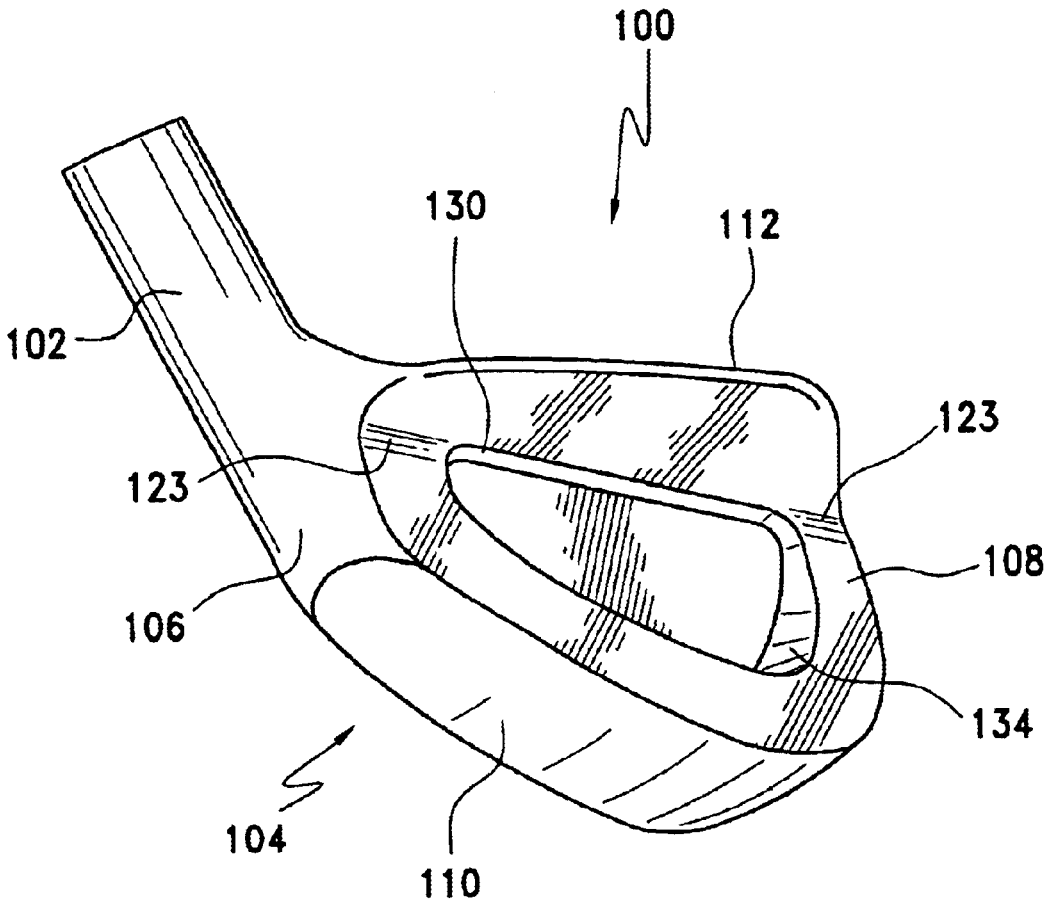
FIG. 1 is a rear perspective view of a golf club head in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as the basis for the claims and as a basis for teaching one skilled in the art how to make and/or use the invention.

FIGS. 1, 2, 3 and 4 illustrate a first embodiment of an iron type golf club head 100 made in accordance with the present invention. The club head 100 includes a hosel 102, and a club head body 104 including a heel 106, toe 108, bottom sole 110, top ridge 112 and a ball striking face 114 with a loft greater than 12 degrees. A leading edge 116 is defined by the intersection of the lower edge of the ball striking face 114 and the forward most progression of the bottom sole 110. These features are generally conventional in design. With most conventional iron type golf clubs the ball striking pattern on the club face usually varies with the caliber of golfer using the equipment.

Figure 2:
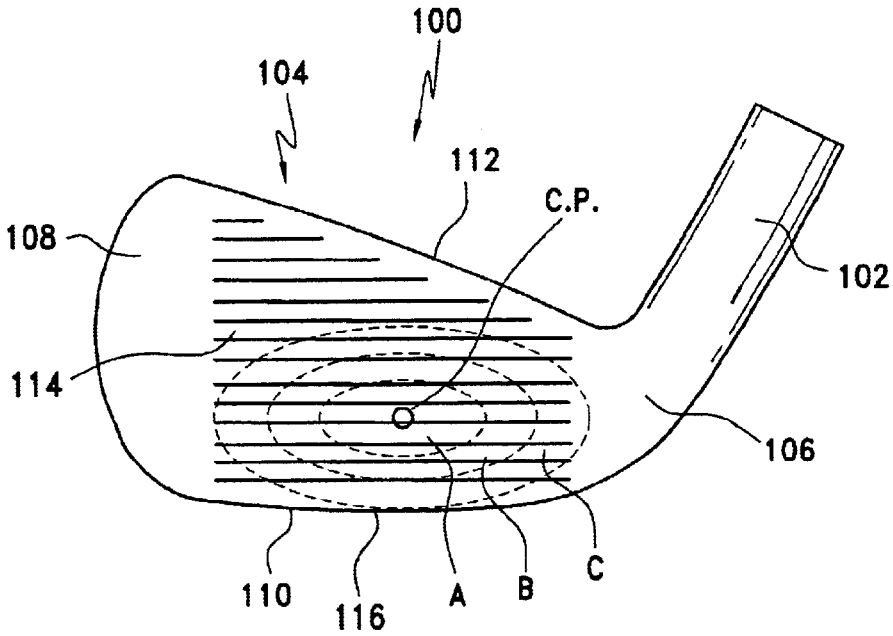
FIG. 2 is a front elevation view of the club head of FIG. 1.
Figure 3:
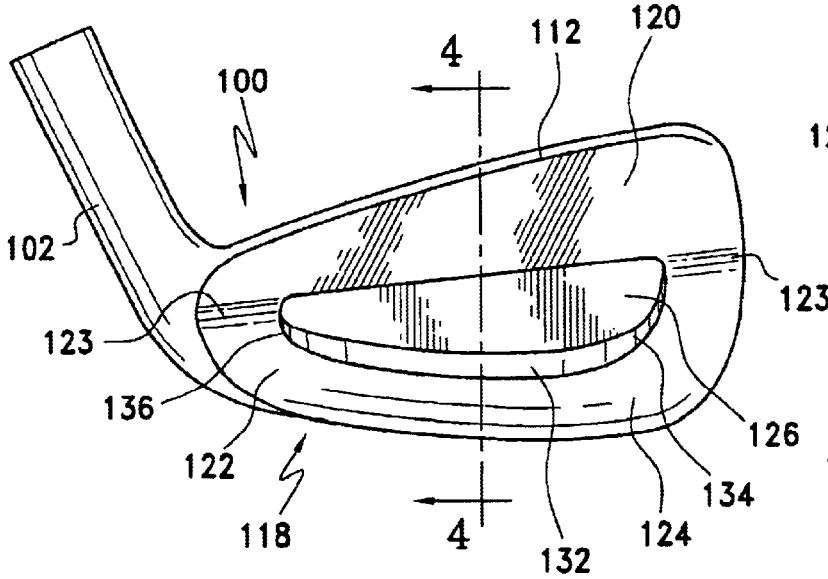
FIG. 3 is a rear elevation view of the club head of FIG. 1.
Figure 4:
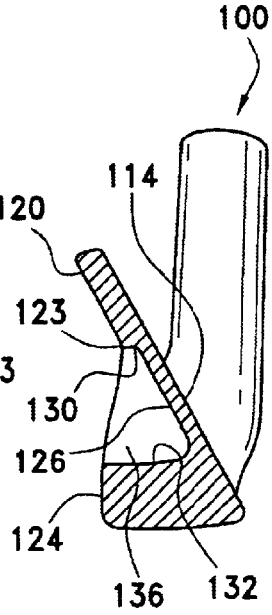
FIG. 4 is a sectional view taken along lines 4—4 of FIG. 3.

As shown in FIG. 2, golfers with a high level of proficiency, such as professionals and low handicap amateurs typically will have a ball striking pattern close to the center of percussion illustrated by the area marked "A" on the drawing. Golfers with more moderate ability typically have a wider pattern identified by the letter "B" on the drawing. Golfers of limited ability have a pattern identified by the letter "C" on the drawing. Therefore, golfers with an A pattern ideally perform better with a golf club having better feel whereas golfers with a C pattern perform better with golf clubs which are more forgiving. No matter what type of golfer, mis-hits usually occur on the bottom part of the club head in a heel to toe direction. Thus the present invention eliminates the cavity from the upper portions of the club head where it is not needed and relocates it to a point where mis-hits occur thus providing a more efficient use of perimeter weighting of a golf club head to accommodate all golfers.

More particularly golf club heads for more accomplished golfers reduce the size of the rear cavity by bringing the upper and lower cavity walls into closer proximity to each other while leaving the toe and heel side walls unmoved. This reduction in cavity size reduces vibration diffusion from ball striking, providing a more solid feel, while the full heel to toe length of the cavity still provides forgiveness on mis-hits. Conversely, a larger cavity for less accomplished golfers provides even more forgiveness while maintaining the perimeter weight only on the bottom of the club head.

The present invention is an iron type golf club head with a unique weighting system on the rear surface 118 of the club head 100. The rear surface is formed with an upper portion 120, a lower portion 122 and an interface 123 defining the transition area between the upper portion 120 and the lower portion 122. The upper portion 120 of the rear surface 118 is a blade type construction and is located just below the top ridge 112, the lower portion 122 of the rear surface 118, is progressively thicker from behind the center of percussion on the club face extending downwardly to the bottom sole 110. The lower portion is formed with a rear peripheral weight 124 and cavity 126 formed therefrom, which is located on and recessed into the rear surface 118 below the upper portion 120. The peripheral weight 124 extends from the interface 123 to the bottom sole 110. The cavity is formed with an upper side wall 130, bottom side wall 132 and toe side wall 134 and heel side wall 136. In this embodiment the cavity upper side wall 130 is coincident with the interface 123 defining the transition between the upper portion 120 and the lower portion 122. The peripheral weight 124 and cavity 126 creates a section of the club head which is more forgiving when golf balls are struck away from the center of percussion because of increased moment of inertia of the peripheral weight. Therefore, the lower portion 122 of the club head 100 provides more forgiveness where mis-hits most often occur, while the blade type configuration of the upper portion provides increased feel. Thus the present iron club head provides the benefits of both blade and perimeter weighted golf clubs in a single club head.

With the above described structure, a majority of the weight is located on a lower part of the rear surface 118 of the club head 100. The peripheral weight 124 is located at approximately the lower two thirds of the rear surface 118 of the club head 100, however, it will be appreciated that the peripheral weight 124 may extend higher or lower in accordance with the preselected characteristics of a golf club made with the club head of the present invention, as described in various embodiments of the invention.

The embodiments described herein below, are similar to the embodiment described above with reference to FIGS. 1–4, including the frontal portions of the club head illustrated in FIG. 2, and these features of the entire club head are incorporated herein by reference, with only the back portion of club heads shown and described herein below for the purpose of clarity and focus on the invention.

Figure 5:
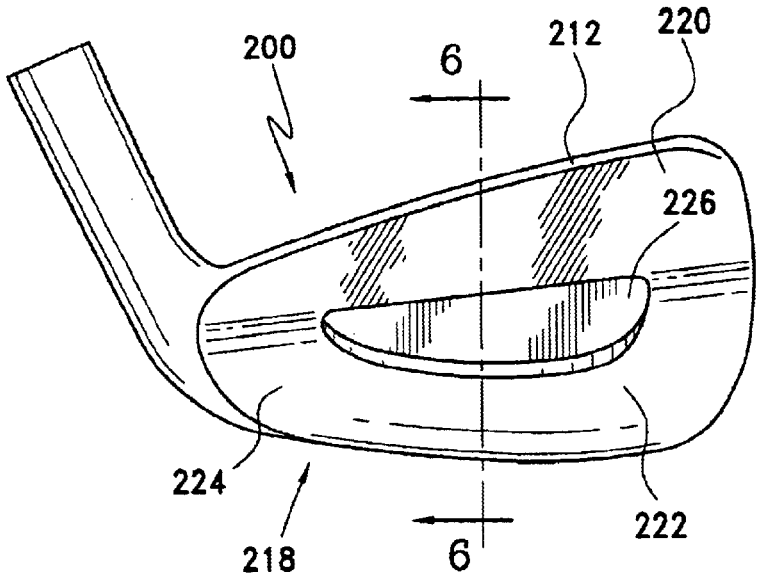
FIG. 5 is a rear elevation view of a second embodiment of a golf club head in accordance with the present invention.
Figure 6:
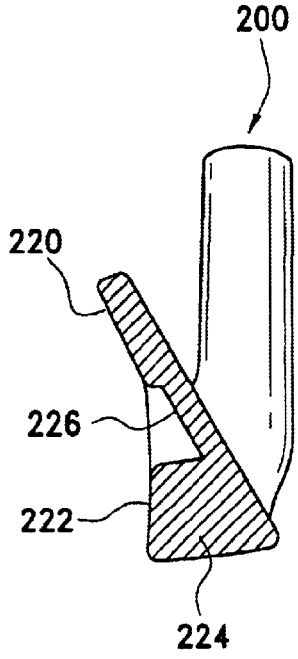
FIG. 6 is a sectional view taken along lines 6—6 of FIG. 5.

FIGS. 5 and 6 illustrate a second embodiment of the present invention. An iron type club head 200 includes a rear surface 218 including an upper portion 220 with a blade configuration below the top ridge 212 of the club head 200. A lower portion 222 of the rear surface 218 is formed with a thicker peripheral weight 224 and rear cavity 226. In this embodiment, the cavity 226 is smaller and or shallower than the first embodiment and it is located more directly behind the center of percussion on the ball striking face to accommodate golfers with higher skill levels.

Figure 7:
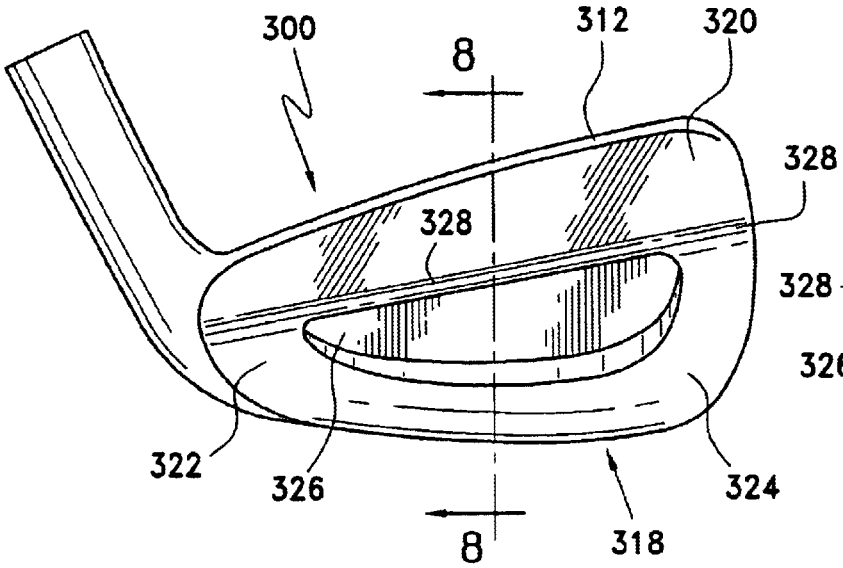
FIG. 7 is a rear elevation view of a third embodiment of a golf club head in accordance with the present invention.
Figure 8:
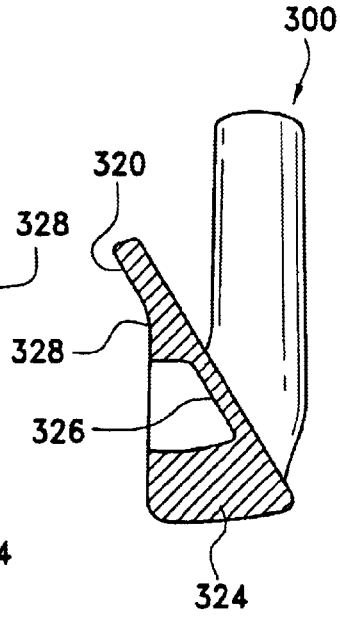
FIG. 8 is a sectional view taken along lines 8—8 of FIG. 7.

FIGS. 7 and 8 illustrate a third embodiment of a golf club head 300 of the present invention, which includes a rear surface 318 including an upper portion 320 with a blade configuration below the top ridge 312 of the club head 300. A lower portion 322 of the rear surface 318 is formed with a thicker peripheral weight 324 and rear cavity 326. In this embodiment the rear cavity is located totally within the lower portion 322 and the interface 328 is a smooth, arcuate surface forming the transition area between the upper portion 320 and the lower portion 322.

FIGS. 9 and 10 illustrate a forth embodiment of a golf club head 400 of the present invention, which includes a rear surface 418 including an upper portion 420 with a blade configuration below the top ridge 412 of the club head 400. A lower portion 422 of the rear surface 418 is a generally muscle back type structure formed with a thicker peripheral weight 424 and rear cavity 426. In this embodiment the peripheral weight 424 extend outwardly from the rear surface 418. The peripheral weight 424 and cavity extend at least two thirds of the distance between the top ridge 412 and the bottom sole 410. The upper part of the peripheral weight 424 includes a mass 428, which extends outwardly from the rear surface 418 at the interface 423 between the upper portion 420 and the lower portion 422 and includes a ledge 430 which defines the upper edge of the peripheral weight 424. The cavity 426 is generally oval in shape and has the same thickness as the upper portion 420.

FIG. 11 illustrates a fifth embodiment of a golf club head 500 of the present invention, which includes a rear surface 518 including an upper portion 520 with a blade configuration below the top ridge 512 of the club head 500. A lower portion 522 of the rear surface 518 is formed with a thicker peripheral weight 524 located toward the toe and a rear cavity 526, located toward the heel 506 of the club head 500 to accommodate golfers who tend to fade or slice the golf ball.

FIG. 12 illustrates a sixth embodiment of a golf club head 600 of the present invention, which includes a rear surface 618 including an upper portion 620 with a blade configuration below the top ridge 612 of the club head 600. A lower portion 622 of the rear surface 618 is formed with a thicker peripheral weight 624 located toward the heel 606 and a rear cavity 626, which is located toward the toe 608 of the club head to accommodate golfers who tend to hook the a golf ball.

Figure 13:
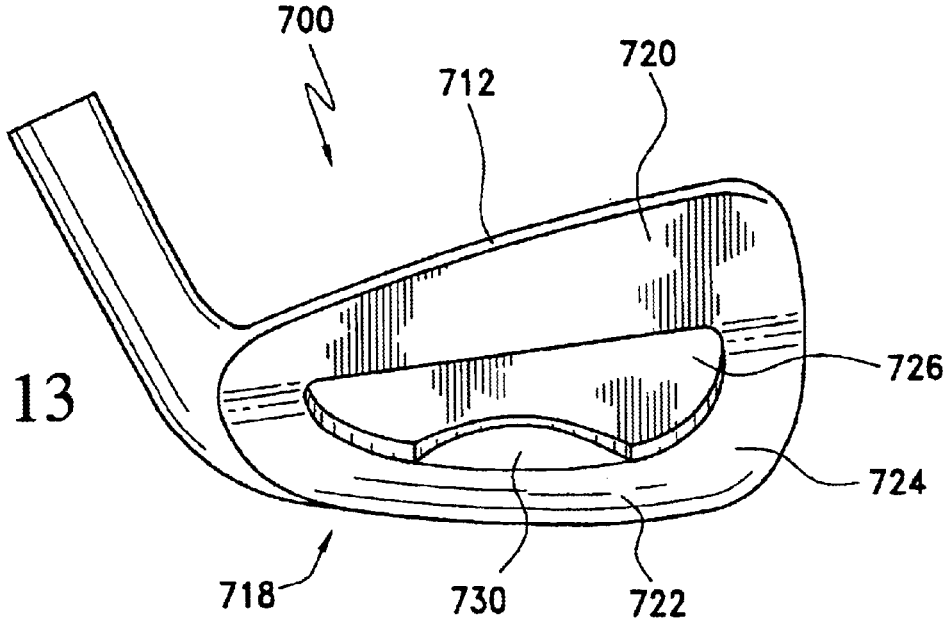
FIG. 13 is a rear elevation view of a seventh embodiment of a golf club head in accordance with the present invention.

FIG. 13 illustrates a seventh embodiment of a golf club head 700 of the present invention, which includes a rear surface 718 including an upper portion 720 with a blade configuration below the top ridge 712 of the club head 700. A lower portion 722 of the rear surface 718 is formed with a thicker peripheral weight 724 and rear cavity 726. In this embodiment, an extension 730 of the thicker peripheral weight 724 is formed into the rear cavity 726 adding additional weight within the cavity 726, closer to the center of percussion on the club face to facilitate specific ball striking performance.

Figure 14:
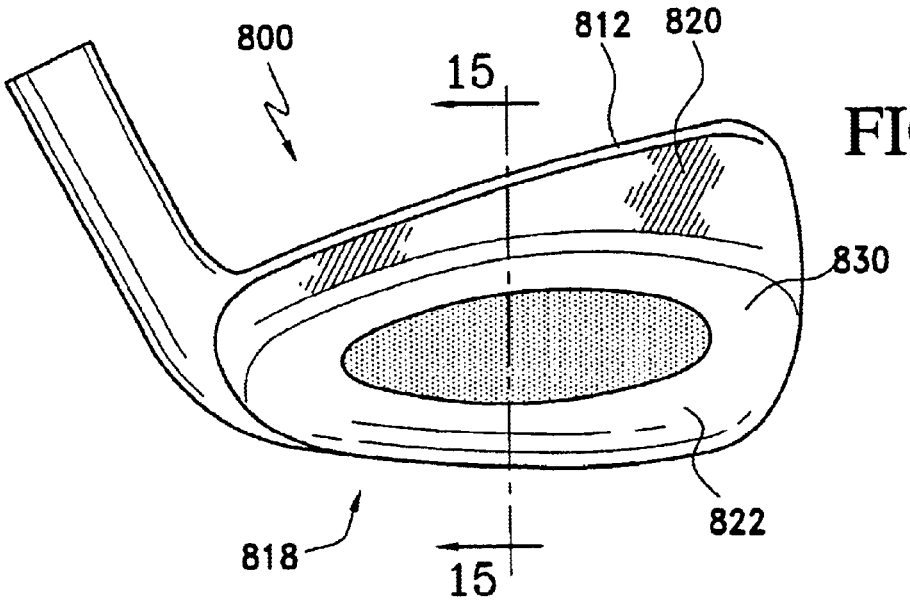
FIG. 14 is a rear elevation view of a eighth embodiment of a golf club head in accordance with the present invention.
Figure 15:
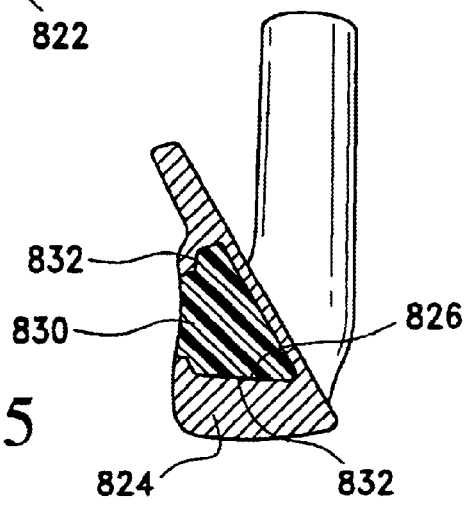
FIG. 15 is a sectional view taken along lines 15—15 of FIG. 15.

FIGS. 14 and 15 illustrate an eighth embodiment of a golf club head 800 of the present invention, which includes a rear surface 818 including an upper portion 820 with a blade configuration below the top ridge 812 of the club head 800. A lower portion 822 of the rear surface 818 is formed as a muscle back structure and includes a thicker peripheral weight 824 and rear cavity 826. In this embodiment, an insert 830, made of elastomer or other vibration absorbing material, fills the rear cavity 826 to absorb shock and vibration which occurs when a golf ball is struck with the club head 800. Preferably the rear cavity 826 is formed with sides 832 which are undercut to facilitate retention of the insert 830.

Figure 16:
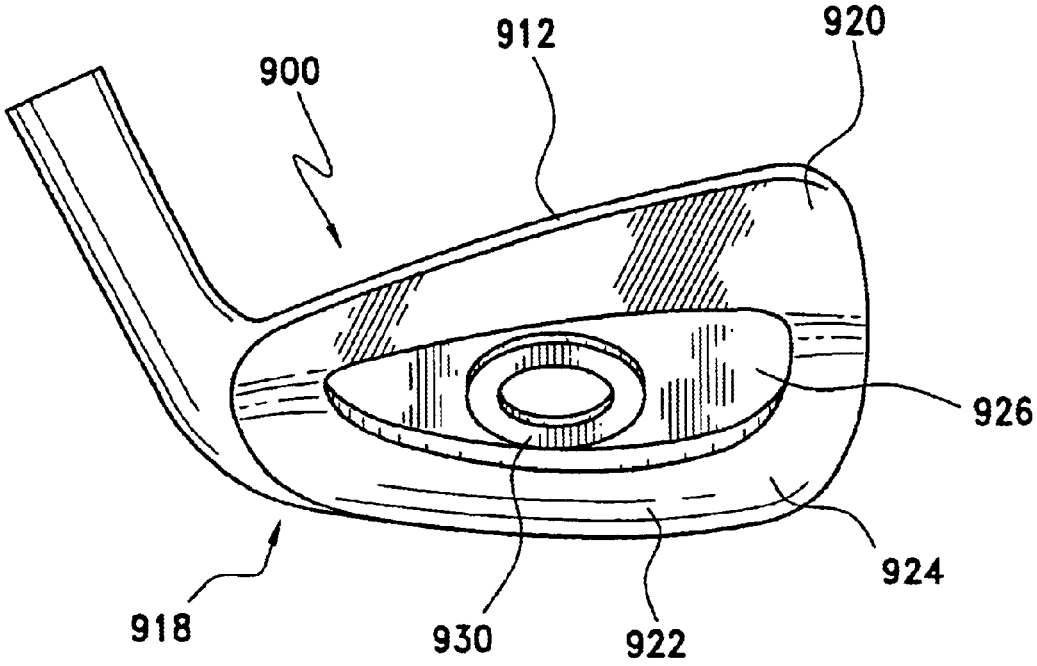
FIG. 16 is a rear elevation view of a ninth embodiment of a golf club head in accordance with the present invention.

FIG. 16 illustrates a ninth embodiment of a golf club head 900 of the present invention, which includes a rear surface 918 including an upper portion 920 with a blade configuration below the top ridge 912 of the club head 900. A lower portion 922 of the rear surface 918 is formed with a thicker peripheral weight 924 and rear cavity 926. An additional weight member 930 is included within the cavity 926 to facilitate specific ball striking performance. The weight member 930 may be made in any of a variety of shapes and configurations, including, but not limited to, logo designs to identify the maker of the club head.

Figure 17:
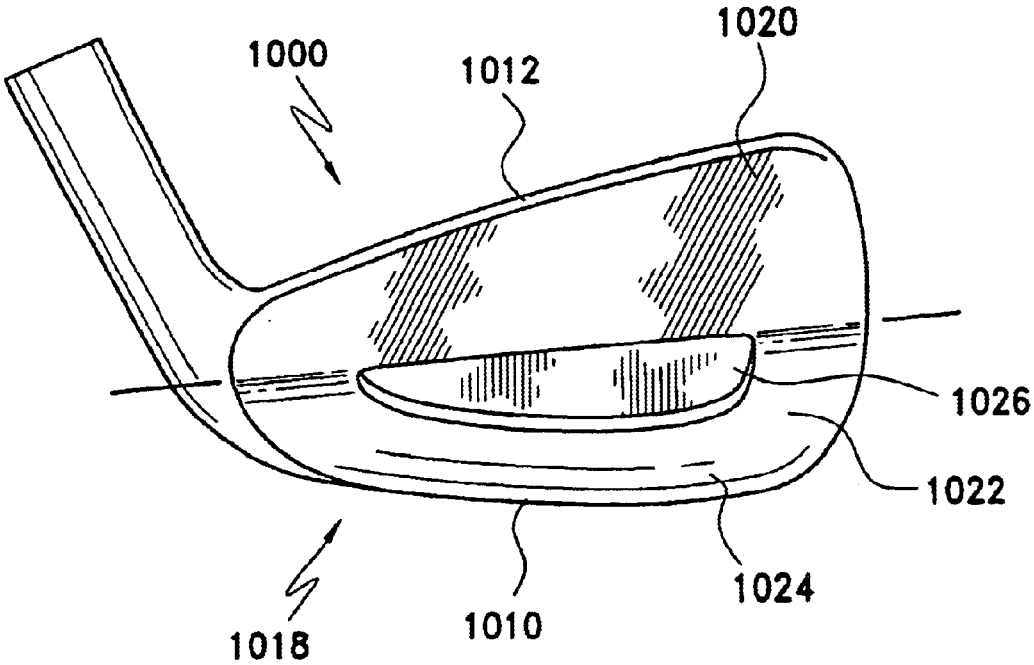
FIG. 17 is a rear elevation view of a tenth embodiment of a golf club head in accordance with the present invention.

FIG. 17 illustrates a tenth embodiment of a golf club head 1000 of the present invention, which includes a rear surface 1018 including an upper portion 1020 with a blade configuration below the top ridge 1012 of the club head 1000. A lower portion 1022 of the rear surface 1018 is formed with a thicker peripheral weight 1024 and rear cavity 1026. The lower muscle back portion 1024 extends approximately half the distance between the top ridge 1012 and the bottom sole 1010 of the club head 1000 such that the interface 1023 between the upper portion 1020 and the lower portion 1022 is located approximately midway between the top ridge 1012 and the bottom sole 1010.

Figure 18:
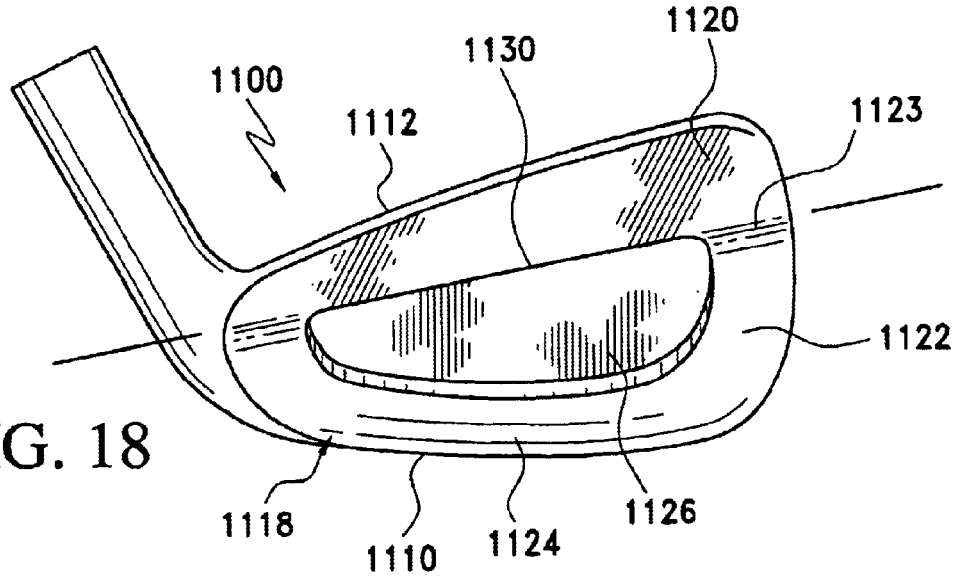
FIG. 18 is a rear elevation view of an eleventh embodiment of a golf club head in accordance with the present invention.

FIG. 18 illustrates an eleventh embodiment of a golf club head 1100 of the present invention, which includes a rear surface 1118 including an upper portion 1120 with a blade configuration below the top ridge 1112 of the club head 1100. A lower portion 1122 of the rear surface 1118 is formed with a thicker peripheral weight 1124 and rear cavity 1126. The lower portion 1122 and the upper edge 1130 of the rear cavity 1126 extends approximately two thirds of the distance to the interface 1123 between the top ridge 1112 and the bottom sole 1110 of the club head 1100.

Figure 19:
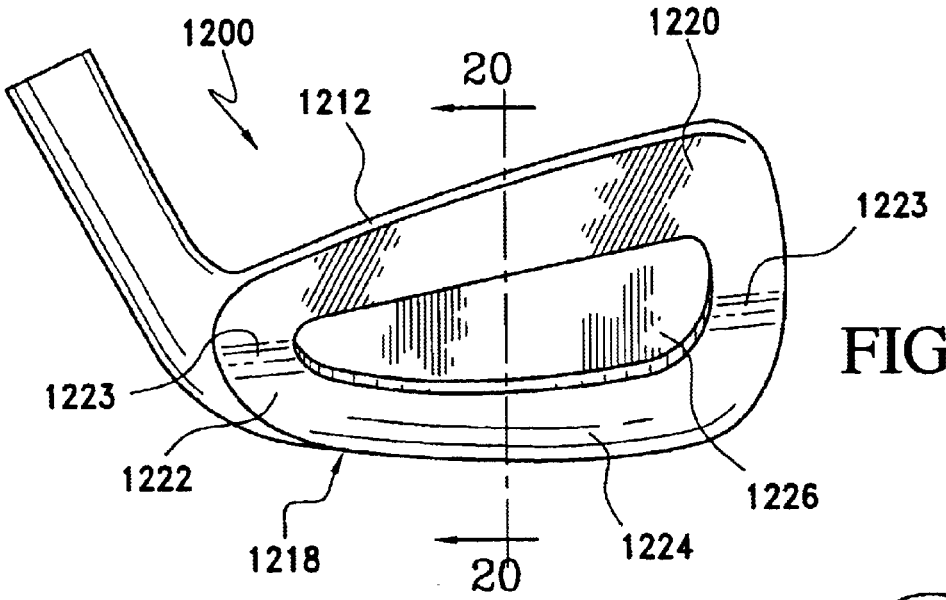
FIG. 19 is a rear elevation view of a twelfth embodiment of a golf club head in accordance with the present invention.
Figure 20:
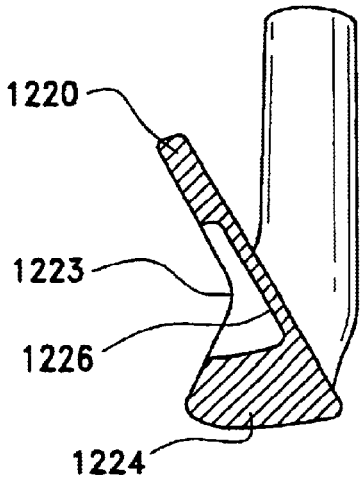
FIG. 20 is a sectional view taken along lines 20—20 of FIG. 19.

FIGS. 19 and 20 illustrate a twelfth embodiment of a golf club head 1200 of the present invention, which includes a rear surface 1218 including an upper portion 1220 with a blade structure below the top ridge 1212 of the club head 1200. A lower portion 1222 of the rear surface 1218 includes a thicker peripheral weight 1224 and a recessed rear cavity 1226. In this embodiment, the rear cavity 1226 extends upwardly toward the top ridge 1212 past the interface 1223 and into the blade structure of the upper portion 1220.

Figure 21:
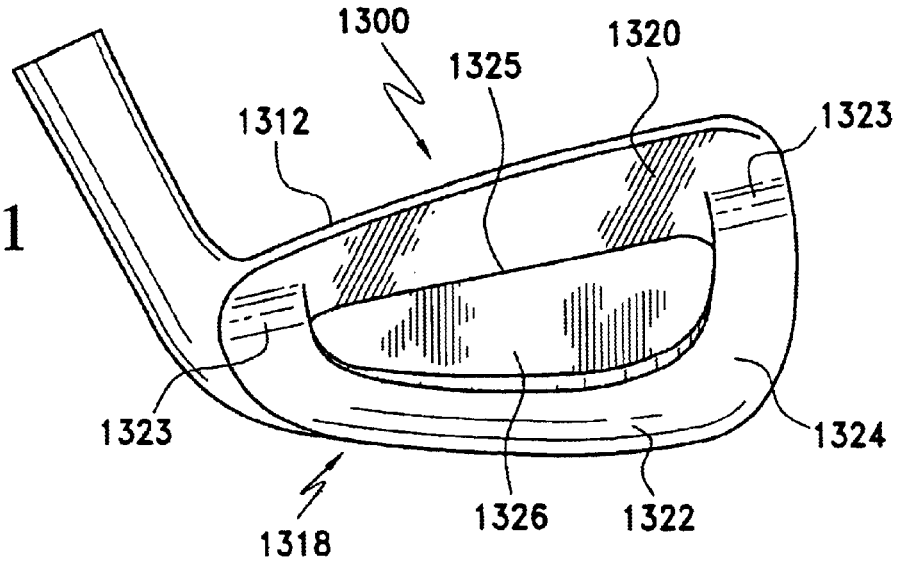
FIG. 21 is a rear elevation view of a thirteenth embodiment of the golf club head in accordance with the present invention.

FIG. 21 illustrates a thirteenth embodiment of a golf club head 1300 of the present invention, which includes a rear surface 1318, including an upper portion 1320 with a blade structure below the top ridge 1312 of the club head 1300. A lower portion 1322 of the rear surface 1318 includes a thicker peripheral weight 1324 and a recessed rear cavity 1326. In this embodiment, the peripheral weight 1324 extends upwardly toward the top ridge 1312 past a top edge 1325 of the rear cavity 1326 and onto the blade structure of the upper portion 1320 forming an interface 1323 above the cavity 1326.

Figure 22:
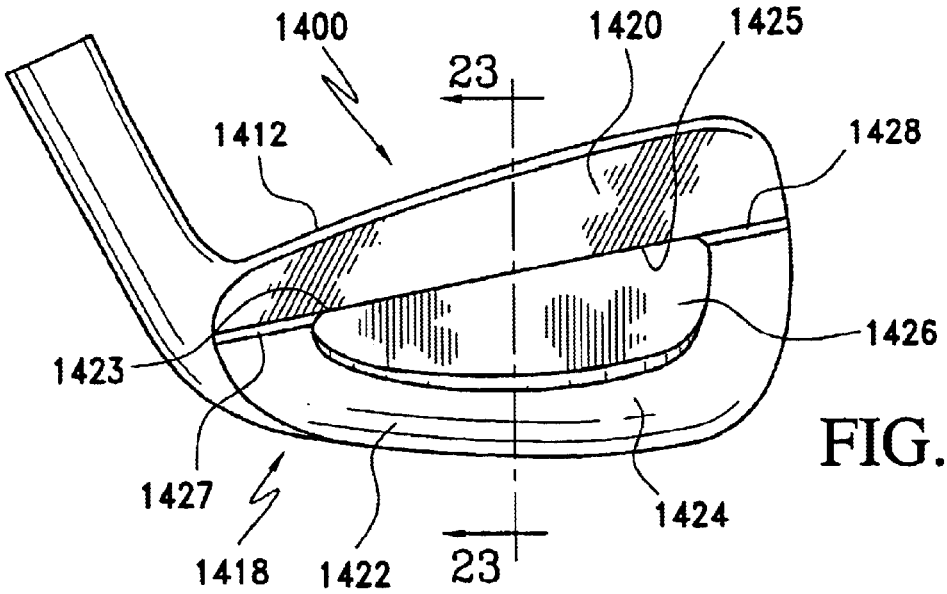
FIG. 22 is a rear elevation view of a fourteenth embodiment of the golf club head in accordance with the present invention.
Figure 23:
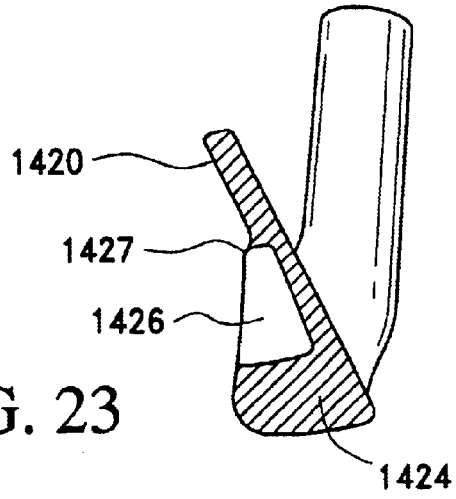
FIG. 23 is a sectional view taken along lines 23—23 of FIG. 22.

FIGS. 22 and 23 illustrate a fourteenth embodiment of a golf club head 1400 having a rear surface 1418, including an upper portion 1420 with a blade structure below the top ridge 1412 of the club head 1400. A lower portion 1422 of the rear surface1418 includes a thicker peripheral weight 1424 and a rear cavity 1426. In this embodiment, the upper edges 1427 and 1428 of the peripheral weight 1424 abruptly end and are coincident with a top edge 1425 of the rear cavity 1426 and an interface 1423 between the upper portion 1420 lower portion 1422. The upper edges 1427 and 1428 are shown as a ledge or shelf structure but it will be appreciated these edge surfaces may be curved, arcuate or other similar shapes.

While preferred embodiments have been shown and described, it will be understood that there is no intent to limit the invention by such disclosure, but rather, it is intended to cover all modifications and alternate constructions falling within the spirit and scope of the invention as defined in the following appended claims.

What is claimed is:

1. An iron type golf club head having a club head body and means for connection to a shaft; said club head body including a heel, toe, a ball striking face, a top ridge surface and bottom sole surface, wherein the improvement comprises:

a rear surface having separate upper and lower portions; said upper portion and said lower portion extending across said rear surface from adjacent said heel to adjacent said toe; said upper portion extending downwardly toward said bottom sole approximately one-third the distance between said top ridge and said bottom sole;

said lower portion located below said upper portion and said lower portion being within an approximate lower two-thirds of said rear surface in a direction between said bottom sole and said top ridge; the one third upper portion and the two thirds lower portion relationship being maintained entirely across said rear surface from adjacent said heel to adjacent said toe;

said lower portion including a heel to toe, elongated, perimeter weighted cavity located solely in said lower portion of said rear surface; said cavity extending from adjacent said heel to adjacent said toe;

said upper portion being further defined as a non-perimeter weighted, blade type iron structure, having a generally uniform thickness from said heel to said toe;

said lower portion having a thickness becoming progressively thicker as it extends from the upper portion toward said bottom sole;

said club head having a thickness between said elongated cavity and said ball striking face that is thinner than the thickness between the non-cavity upper portion and said ball striking face.

2. The iron type golf club head of claim 1 wherein said elongated, perimeter weighted cavity is formed with a lower surface, a bottom side wall, a toe side wall, a heel side wall and an upper side wall; said walls defining the outer perimeter of said elongated cavity.

3. The iron type golf club head of claim 1 wherein the said upper portion of said rear surface is adjacent to a top edge of said elongated, perimeter weighted cavity in said lower portion of said rear surface.

4. The iron type golf club head of claim 1 wherein said rear surface further includes a mass extending in a heel to toe direction between said upper portion and said elongated, perimeter weighted cavity in said lower portion of said rear surface.

5. The iron type golf club head of claim 1 wherein a bottom edge of said upper portion is defined by a ledge coincident with a top edge of said elongated, perimeter weighted cavity.

6. The iron type golf club head of claim 1 wherein an insert material is located within said elongated, perimeter weighted cavity.

7. The iron type golf club head of claim 1 further including a weighted mass on said rear surface located within said elongated, perimeter weighted cavity.

8. The iron type golf club head of claim 1 further including a ledge coincident with a top edge of said elongated cavity.

9. The iron type club head of claim 1 wherein said perimeter weight formed by said cavity includes a bottom wall and side walls extending up to two thirds the distance between said top ridge and said bottom sole.

* * * * *